US011686437B2

(12) United States Patent
Hikmet et al.

(10) Patent No.: US 11,686,437 B2
(45) Date of Patent: Jun. 27, 2023

(54) LIGHT MIXING CHAMBER AND A LUMINAIRE

(71) Applicant: SIGNIFY HOLDING B.V., Eindhoven (NL)

(72) Inventors: Rifat Ata Mustafa Hikmet, Eindhoven (NL); Johannes Petrus Maria Ansems, Hulsel (NL); Ties Van Bommel, Horst (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/800,468

(22) PCT Filed: Feb. 15, 2021

(86) PCT No.: PCT/EP2021/053581
§ 371 (c)(1),
(2) Date: Aug. 17, 2022

(87) PCT Pub. No.: WO2021/165174
PCT Pub. Date: Aug. 26, 2021

(65) Prior Publication Data

US 2023/0080814 A1 Mar. 16, 2023

(30) Foreign Application Priority Data

Feb. 18, 2020 (EP) ..... 20157845

(51) Int. Cl.

| | |
|---|---|
| ***F21K 9/62*** | (2016.01) |
| ***F21V 19/00*** | (2006.01) |
| ***F21Y 115/10*** | (2016.01) |
| ***F21Y 103/33*** | (2016.01) |

(52) U.S. Cl.
CPC ..... *F21K 9/62* (2016.08); *F21V 19/0045* (2013.01); *F21Y 2103/33* (2016.08); *F21Y 2115/10* (2016.08)

(58) Field of Classification Search
CPC ..... F21K 9/62; F21V 19/0045; F21Y 2301/33
See application file for complete search history.

(56) References Cited

U.S. PATENT DOCUMENTS

| | | | |
|---|---|---|---|
| 9,551,466 | B2 | 1/2017 | Goldstein et al. |
| 2005/0002190 | A1 | 1/2005 | Kramer et al. |
| 2007/0171676 | A1 | 7/2007 | Chang |

(Continued)

FOREIGN PATENT DOCUMENTS

| | | | |
|---|---|---|---|
| EP | 2481971 | A1 | 8/2012 |
| EP | 2592468 | A1 | 5/2013 |
| EP | 3172948 | B1 | 11/2017 |

*Primary Examiner* — Karabi Guharay

(57) ABSTRACT

The present invention relates to a light mixing chamber (100). The light mixing chamber (100) comprising: a first light mixing chamber part (120) comprising a light exit window (122) and a first side wall (124) having a first groove (126); a second light mixing chamber part (140) comprising a bottom wall (142) and a second side wall (144) having a second groove (146); and an LED substrate (160) supporting a plurality of LEDs (162,164,166,168). The LED substrate (160) is arranged into the first (126) and second grooves (146), interconnecting the first and the second light mixing chamber parts (120,140) such that the light mixing chamber (100) is formed. The plurality of LEDs (162,164, 166,168) of the LED substrate (160) is facing an inner cavity (180) of the light mixing chamber (100).

12 Claims, 3 Drawing Sheets

(56) References Cited

U.S. PATENT DOCUMENTS

| | | | |
|---|---|---|---|
| 2010/0238658 | A1 | 9/2010 | Xiang et al. |
| 2016/0312965 | A1 | 10/2016 | Hikmet et al. |
| 2017/0314740 | A1 | 11/2017 | Marinus et al. |

LIGHT MIXING CHAMBER AND A LUMINAIRE

CROSS-REFERENCE TO PRIOR APPLICATIONS

This application is the U.S. National Phase application under 35 U.S.C. § 371 of International Application No. PCT/EP2021/053581, filed on Feb. 15, 2021, which claims the benefit of European Patent Application No. 20157845.7, filed on Feb. 18, 2020. These applications are hereby incorporated by reference herein.

FIELD OF THE INVENTION

The present invention relates to a light mixing chamber and a luminaire.

BACKGROUND OF THE INVENTION

Over the past years, various types of luminaires have been developed. An example of such luminaires is a relatively thin and flat luminaire that can for example be used as a down light. Such luminaires typically have LEDs that are provided on an inner side surface of a light mixing chamber. The internal surfaces of the light mixing chamber of typically has a high light reflectivity and a light exit surface that is covered by a diffusor. However, such conventional luminaires may have poor heat management and low light output efficiency.

US-2007/171676 discloses a backlight module having a housing with opposing sidewalls that extend from the periphery of a base to define an opening. A light diffusion plate is disposed on the opening of the housing. Electric circuit boards carrying LEDs are fixed on inner surfaces of the opposing sidewalls. The housing further has two upper reflective units and two bottom reflective units. Each upper reflective unit is positioned on top of a corresponding sidewall and each bottom reflective unit is positioned on the base, adjacent to the corresponding sidewall. Each upper reflective unit has a protruding portion extending towards the base, and each bottom reflective unit has a protruding portion extending from the base towards the protruding portion of the upper reflective unit.

SUMMARY OF THE INVENTION

It is an object of the present invention to overcome or reduce at least some of the above problems.

According a first aspect, this and other objects are achieved by providing a light mixing chamber. The light mixing chamber comprising a first light mixing chamber part comprising a light exit window and a first side wall having a first inner wall portion and a first outer wall portion, spaced apart and together forming a first groove; a second light mixing chamber part comprising a bottom wall and a second side wall having a second inner wall portion and a second outer wall portion, spaced apart and together forming a second groove; an inner cavity; and an LED substrate having a front surface facing the inner cavity and a back surface facing away from the inner cavity, the front surface supporting a plurality of LEDs.

The LED substrate is arranged into the first and second grooves, interconnecting the first and the second light mixing chamber parts such that the light mixing chamber is formed. In other words, the LED substrate connects the first and second light mixing chamber parts to one another.

The first inner wall portion of the first side wall is extending further away from the light exit window than the first outer wall portion of the first side wall and/or the second inner wall portion of the second side wall is extending further away from the bottom wall than the second outer wall portion of the second side wall.

Between 5% to 50% of the back surface of the LED substrate is covered by the first and second grooves.

The light mixing chamber allows to arrange the LED substrate in the grooves of the first and the second light mixing chamber parts thereby bridging the first and the second light mixing chamber parts. By this arrangement a backside of the LED substrate may be exposed to the surrounding environment, e.g. air. As a result, improved heat dissipation from the LED substrate may be achieved. This since heat may be dissipated directly from the LED substrate to the surrounding environment. Additionally, by arranging the LED substrate in the grooves of the first and the second light mixing chamber parts, at least a portion of a front surface of the LED substrate may be hidden behind the side walls of the light mixing chamber. As a result, improved light output efficiency may be achieved. This since the side walls of the light mixing chamber may be made such that light reflective properties are much better than for light reflective properties of the front surface of the LED substrate. Hence, an inside area of the light mixing chamber having light reflective properties may be increased. The light mixing chamber further facilitates installation and replacement of the LED substrate.

The first side wall comprises a first inner wall portion and a first outer wall portion, spaced apart and together forming the first groove. The second side wall comprises a second inner wall portion and a second outer wall portion, spaced apart and together forming the second groove. Thereby the LED substrate may be inserted in between the inner and the outer wall portions of the first and the second side walls. This may in turn facilitate exposing a substantial portion of the back surface of the LED substrate to the surrounding environment (e.g. air) increasing heat propagation from the LED-substrate. Further, this may facilitate hiding the front surface of the LED-substrate giving design freedom in light reflectivity inside the light mixing chamber.

The first inner wall portion of the first side wall is extending further away from the light exit window than the first outer wall portion of the first side wall. Additionally or alternatively, the second inner wall portion of the second side wall is extending further away from the bottom wall than the second outer wall portion of the second side wall. Thereby, as much as possible portion of the front surface of the LED substrate, facing the inner cavity of the light mixing chamber, may be hidden and as much as possible portion of the back surface of the LED substrate may be exposed to the surrounding environment.

The first inner wall portion of the first side wall may comprise a light reflective inner surface facing the inner cavity of the light mixing chamber. Additionally or alternatively, the second inner wall portion of the second side wall may comprise a light reflective inner surface facing the inner cavity of the light mixing chamber. Thereby, the light may be bounced several times in the light mixing chamber due to the light reflective inner surfaces of the first and the second side walls before exiting the light mixing chamber through the light exit window. The relatively large inner area of the light mixing chamber having light reflective properties may also reduce the amount of light absorbed in the light mixing chamber. Hence, in turn increase the light output efficiency of the light mixing chamber.

The LED substrate may be a flexible elongated substrate. Thereby, facilitating arranging the LED substrate into the first and second grooves. The LED substrate may have a LED substrate length, LED substrate width, and a LED substrate thickness. The LED substrate length is preferably at least 10 times the LED substrate width, more preferably at least 15 times, most preferably at least 20 times. The LED substrate length is preferably at least 10 cm, more preferably at least 15 cm, most preferably at least 20 cm. The LED substrate with is preferably at least 10 times the LED substrate thickness, more preferably at least 15 times, most preferably at least 20 times. The LED substrate thickness is preferably in the range from 0.1 to 3 mm.

The LED substrate may comprise a plurality of fins arranged on the back surface, the surface facing away from the inner cavity, of the LED substrate. Thereby, the fins may act as a heat sink and dissipate the heat directly from the LED substrate to the surrounding environment. Hence, the fins may provide improved thermal management. The fins may preferably be arranged in an opposite direction with respect to a length of the LED substrate. Thereby, allowing flexing or bending of the LED substrate for being arranged into the first and second grooves.

The plurality of LEDs may have a light emitting surface which may be arranged at a distance from the first inner wall portion of the first side wall and from the second inner wall portion of the second side wall. The distance between the light emitting surface of the plurality of LEDs and the inner wall portion of the first side wall may facilitate homogeneous lighting at the light exit window. The distance between the light emitting surface of the plurality of LEDs and the first inner wall portion of the first side wall may at least be 1 mm. The distance between the light emitting surface of the plurality of LEDs and the first inner wall portion of the first side wall may preferably be from 1 to 10 mm.

The first side wall may extend along a circumference of the light exit window of the first light mixing chamber part. The second side wall may extend along a circumference of the bottom wall of the second light mixing chamber part. Thereby, a lateral dimension of the first side wall and the second side wall i.e. a dimension of the first side wall and the second side wall along the top and the bottom walls may increase. This may in turn allow to increase a length of the LED substrate to improve heat dissipation and also increase a number of LEDs of the plurality of LEDs.

Between 5% to 50% of the back surface of the LED substrate, the surface facing away from the inner cavity, is covered by the first and second grooves. Thereby, improving the heat dissipation. More preferably, between 5% to 40% of the back surface of the LED substrate may be covered by the first and second grooves. Most preferably, between 5% to 30% of the back surface of the LED substrate may be covered by the first and second grooves. The first groove may extend along a circumference of the light mixing chamber. The second groove may extend along the circumference of the light mixing chamber. The first groove may extend along a circumference of the first light mixing chamber part. The second groove may extend along a circumference of the second light mixing chamber part. Thereby, a lateral dimension of the first groove and the second groove i.e. a length of the first groove and the second groove along the top and the bottom walls may increase. This may in turn facilitate the heat dissipation by increasing areas of the first and the second grooves.

The first and second grooves may cover the front surface, the surface facing the cavity, of the LED substrate such that substantially only the plurality of LEDs may face the inner cavity of the light mixing chamber. Thereby, improving both light output efficiency and the heat dissipation.

The LED substrate may extend along the circumference of the light mixing chamber. Thereby, a lateral dimension of the LED substrate i.e. a length of the LED substrate along the top and the bottom walls may increase. This may in turn allow increasing a number of LEDs of the plurality of LEDs.

The bottom wall may comprise a light reflective inner surface facing the inner cavity of the light mixing chamber. Thereby, the light may be bounced several times in the light mixing chamber due to the light reflective inner surface of the bottom wall before exiting the light mixing chamber. The relatively large inner area of the light mixing chamber having light reflective properties may also reduce the amount of light absorbed in the light mixing chamber. Hence, in turn increase the light output efficiency of the light mixing chamber. The light reflectance of the inner surface may preferably be larger than 85%. The light reflectance of the inner surface may more preferably be larger than 90%. The light reflectance of the inner surface may most preferably be larger than 92%.

The light exit window may be light diffusive e.g. a semi-reflective light exit window. The light exit window may have a reflectance in the range from 30% to 80% for light emitted from the plurality of LEDs. This may in turn allow obtaining a uniform light emission through the diffusive light exit window. The light exit window may preferably have a reflectance in the range from 35% to 75%. The light exit window may more preferably have a reflectance in the range from 40% to 70%. The light exit window may most preferably have a reflectance in the range from 45% to 60%.

The LED-substrate may comprise two or more LED substrate portions. Alternatively, or in combination, the LED-substrate may be flexible and/or bendable. Thereby, light mixing chambers with various shapes and forms may be provided. For instance, a rectangular light mixing chamber having rectangular top and bottom walls may be provided using four LED-substrate portions or a circular light mixing chamber may be provided using a flexible LED-substrate.

According a second aspect of the present inventive concept, a luminaire is provided comprising the light mixing chamber, according to the first aspect of the present inventive concept, and a driver for driving the plurality of LEDs. This aspect may generally present the same or corresponding advantages as the former aspect.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the device described or steps of the methods described as such device and method may vary. It is also to be understood that the terminology used herein is for purpose of describing particular embodiments only and is not intended to be limiting. It must be noted that, as used in the specification and the appended claim, the articles "a," "an," and "the" are intended to mean that there are one or more of the elements unless the context clearly dictates otherwise. Thus, for example, reference to "a device" or "the device" may include several devices, and the like. Furthermore, the words "comprising", "including", "containing" and similar wordings does not exclude other elements or steps.

BRIEF DESCRIPTION OF THE DRAWINGS

The above and other aspects of the present invention will now be described in more detail, with reference to the appended drawings showing embodiments of the invention. The figures should not be considered limiting the invention to the specific embodiment; instead they are used for explaining and understanding the invention.

As illustrated in the figures, the sizes of components are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
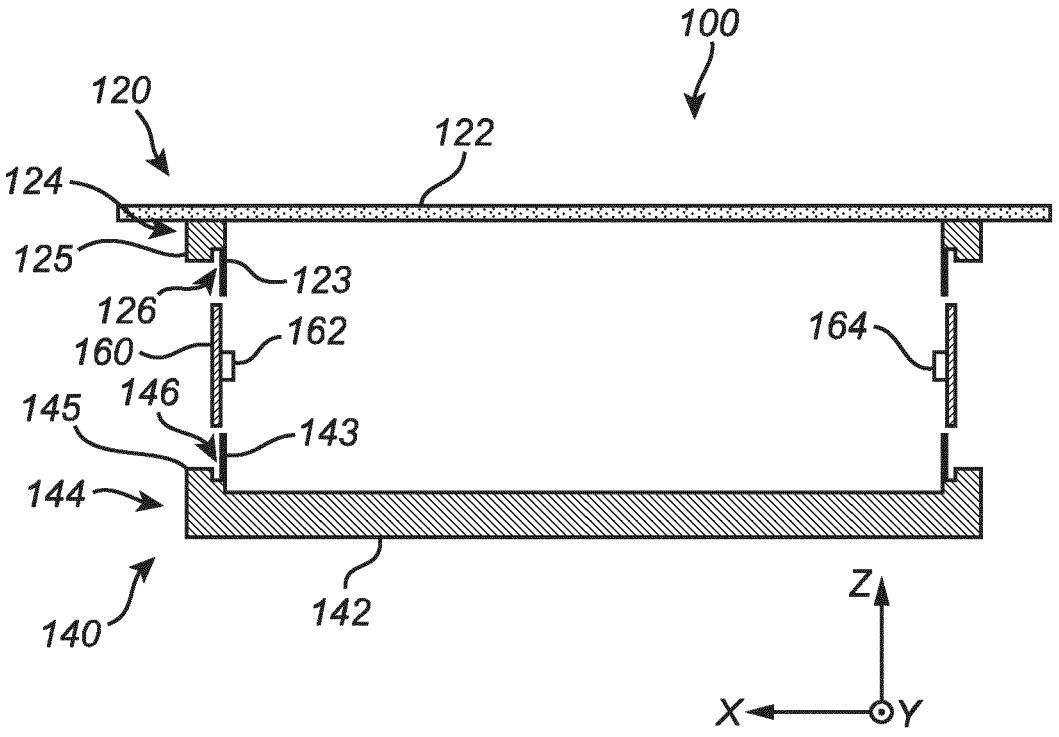
FIG. 1 illustrates a cross-sectional side view of different parts of a light mixing chamber prior to assembling the different parts.

FIG. 1 illustrates a cross-sectional side view of different parts of a light mixing chamber 100 prior to assembling the different parts for forming the light mixing chamber 100. The light mixing chamber 100 comprises a first light mixing chamber part 120 and a second light mixing chamber part 140. The first and the second light mixing chamber parts 120 and 140 may be manufactured by means of fused deposition modelling (FDM). The first and the second light mixing chamber parts 120 and 140 may be manufactured by any other means such as injection molding, compression molding, or vacuum forming. The first and the second light mixing chamber parts 120 and 140 may have different forms and sizes. For instance, the first and the second light mixing chamber parts 120 and 140 may have a circular, an oval, a rectangular, a hexagonal or a square shape. A dimension of the first and the second light mixing chamber parts 120 and 140 along X and Y axes, shown in FIG. 1, may be in a range of 3 to 300 mm. A dimension of the first and the second light mixing chamber parts 120 and 140 along an axis Z, shown in FIG. 1, may be in a range of 0.3 to 6 cm.

The first light mixing chamber part 120 comprises a light exit window 122. The light exit window 122 may be light diffusive. The light exit window 122 may be light diffusive for visible light having a reflectance in the range from 30% to 80%. The light exit window 122 may be formed of a polymer. The polymer may be translucent, preferably diffuse. The polymer may comprise light scattering material such $TiO_2$, $BaSO_4$, and/or $Al_2O_3$ particles. The second light mixing chamber part 140 comprises a bottom wall 142. The bottom wall 142 may comprise a light reflective inner surface facing an inner cavity 180 to be formed by connecting different parts of the light mixing chamber 100. For instance, the inner surface of the bottom wall 142 may be coated by a light reflective material. The bottom wall 142 may be made of white diffusive and high reflective material. The bottom wall 142 may comprise a light reflective material. The bottom wall 142 may e.g. comprise high $TiO_2$ loaded plastics, or high reflective sheet material such as MCPET.

The first light mixing chamber part 120 comprises a first side wall 124 having a first groove 126. The second light mixing chamber part 140 comprises a second side wall 144 having a second groove 146. The first side wall 124 and the second side wall 144 may comprise a polymer e.g. PC, PET, PE, silicone. The first side wall 124 and the second side wall 144 may comprise particles e.g. light reflective particles, e.g. reflective Al and/or Ag flakes or light scattering particles e.g. $BaSO_4$, $Al_2O_3$ and/or $TiO_2$. A dimension of the first side wall 124 and the second side wall 144 along the Z axis, shown in FIG. 1, may preferably be in a range of 0.3 to 6 cm. The dimension of the first side wall 124 and the second side wall 144 along the Z axis, shown in FIG. 1, may more preferably be in a range of 0.4 to 4 cm. The dimension of the first side wall 124 and the second side wall 144 along the Z axis, shown in FIG. 1, may most preferably be in a range of 0.5 to 3 cm.

The first side wall 124 may comprise a first inner wall portion 123 and a second outer wall portion 125. The second outer wall portion 125 may be a continuous wall or a non-continuous wall. The first inner wall portion 123 and the first outer wall portion 125 of the first side wall 124 are spaced apart from each other. A distance between the first inner wall portion 123 and the first outer wall portion 125 of the first side wall 124 may be in a range of 0.5 to 3 mm. The first inner wall portion 123 and the first outer wall portion 125 of the first side wall 124 together form the first groove 126.

The second side wall 144 may comprise a second inner wall portion 143 and a second outer wall portion 145. The second outer wall portion 145 may be a continuous wall or a non-continuous wall. The second inner wall portion 143 and the second outer wall portion 145 of the second side wall 144 are spaced apart from each other. A distance between the second inner wall portion 143 and the second outer wall portion 145 of the second side wall 144 may be in a range of 0.5 to 3 mm. The second inner wall portion 143 and the second outer wall portion 145 of the second side wall 144 together form the second groove 146.

The first inner wall portion 123 of the first side wall 124 may extend further away from the light exit window 122 than the first outer wall portion 125 of the first side wall 124. In other words, a length of the first inner wall portion 123 of the first side wall 124 along the Z axis, see FIG. 1, may be longer than a length of the first outer wall portion 125 of the first side wall 124 along the Z axis. The second inner wall portion 143 of the second side wall 144 may extend further away from the bottom wall 142 than the second outer wall portion 145 of the second side wall 144. In other words, a length of the second inner wall portion 143 of the second side wall 144 along the Z axis, see FIG. 1, may be longer than a length of the second outer wall portion 145 of the second side wall 144 along the Z axis. The first inner wall portion 123 of the first side wall 124 may comprises a light reflective inner surface facing an inner cavity 180 to be formed by connecting different parts of the light mixing chamber 100. For instance, the first inner wall portion 123 of the first side wall 124 may be coated by a light reflective material. The first inner wall portion 123 of the first side wall 124 may be formed of a light reflective inner surface. The second inner wall portion 143 of the second side wall 144 may comprises a light reflective inner surface facing an inner cavity 180 to be formed by connecting different parts of the light mixing chamber 100. For instance, the second inner wall portion 143 of the second side wall 144 may be coated by a light reflective material. The second inner wall portion 143 of the second side wall 144 may be formed of a light reflective inner surface.

The light mixing chamber 100 further comprises a LED substrate 160. The LED substrate 160 may be thermally conductive. The LED substrate 160 may comprise a metal. For instance, the LED substrate 160 may comprise Copper (Cu) and/or Aluminum (Al). The LED substrate 160 may be a flexible elongated substrate e.g. a flexible LED strip. The LED substrate 160 may comprise two or more LED substrate portions. The LED substrate 160 supports a plurality of LEDs. The plurality of LEDs may preferably comprise at least 10 LEDs. The plurality of LEDs may more preferably comprise at least 15 LEDs. The plurality of LEDs may most preferably comprise at least 20 LEDs. Two LEDs 162 and 164 of the plurality of LEDs are shown in FIG. 1. FIG. 1 further shows that the plurality of LEDs 162 and 164 have a light emitting surface. The light emitting surface of the plurality of LEDs 162 and 164 is arranged at a distance from the first inner wall portion 123 of the first side wall 124 and from the second inner wall portion 143 of the second side wall 144. The plurality of LEDs may comprise various types of LEDs such organic LEDs (OLED). The plurality of LEDs may comprise white LEDs e.g. cool white (CW) or warm white (WW). The plurality of LEDs may comprise colored LEDs e.g. red, green, or blue LEDs. The plurality of LEDs may comprise any of or any combination of white and colored LEDs. The LED substrate may further comprise a plurality of fins arranged on a back surface, the surface facing away from the cavity 180, of the LED substrate 160. The fins may be optionally be arranged along the Z axis. In the case that the first outer wall portion 125 of the first side wall 124 and the second outer wall portion 145 of the second side wall 144 are non-continuous, the first and second outer wall portions 125 and 145 may be non-continuous at the positions of the fins. An inner surface of the LED substrate may preferably be highly reflective.

Figure 2:
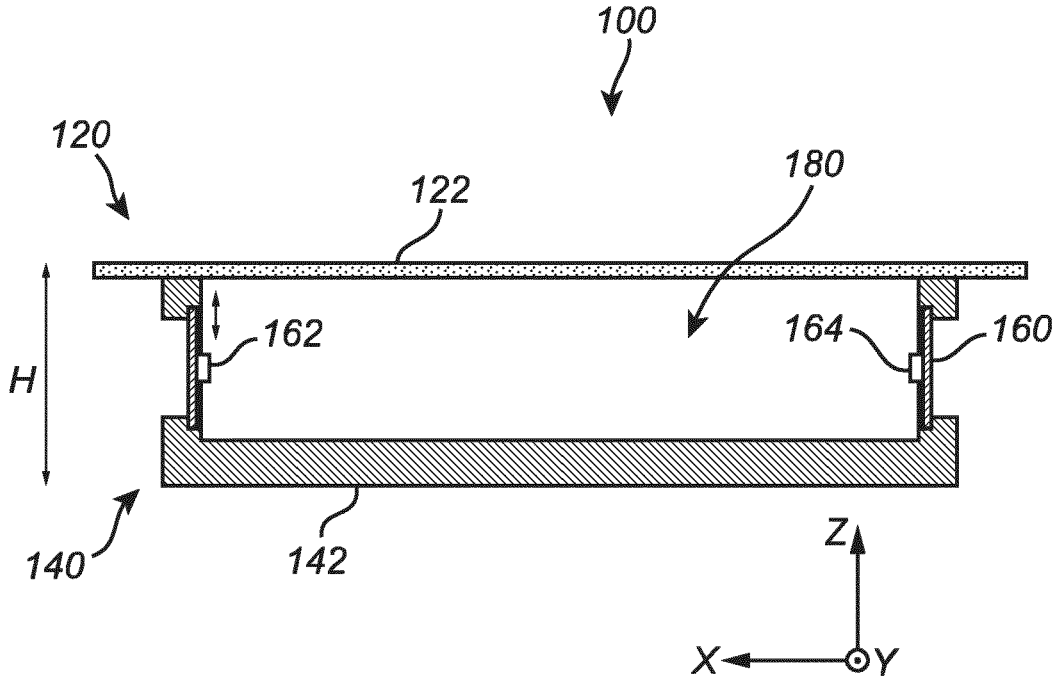
FIG. 2 illustrates a cross-sectional side view of a light mixing chamber, subsequent to assembling different parts.

FIG. 2 illustrates a cross-sectional side view of the light mixing chamber 100, subsequent to assembling different parts. Hence, in FIG. 2 the different parts of the light mixing chamber 100 are assembled forming the light mixing chamber 100. The LED substrate 160 is arranged into the respective first 126 and second grooves 146 of the first and the second light mixing chamber parts 120 and 140. Between 5% to 50% of a back surface of the LED substrate 160, the surface facing away from the inner cavity 180, may be covered by the first 126 and second grooves 146. FIG. 2 shows that the first 126 and second grooves 146 cover a front surface, the surface facing the cavity 180, of the LED substrate 160. FIG. 2 further shows that substantially only the plurality of LEDs 162 and 164 faces the inner cavity 180 of the light mixing chamber 100. The LED substrate 160 interconnects the first and the second light mixing chamber parts 120,140, in other words, the LED substrate 160 connects the first and second light mixing chamber parts 120 and 140, respectively, to one another, and forms the light mixing chamber 100. The light mixing chamber 100 has an inner cavity 180. The plurality of LEDs 162 and 164 of the LED-substrate 160 face the inner cavity 180 of the light mixing chamber 100. A height of the light mixing chamber along the Z axis shown by H in FIG. 2 may be in a range of 10 to 100 mm.

Figure 3:
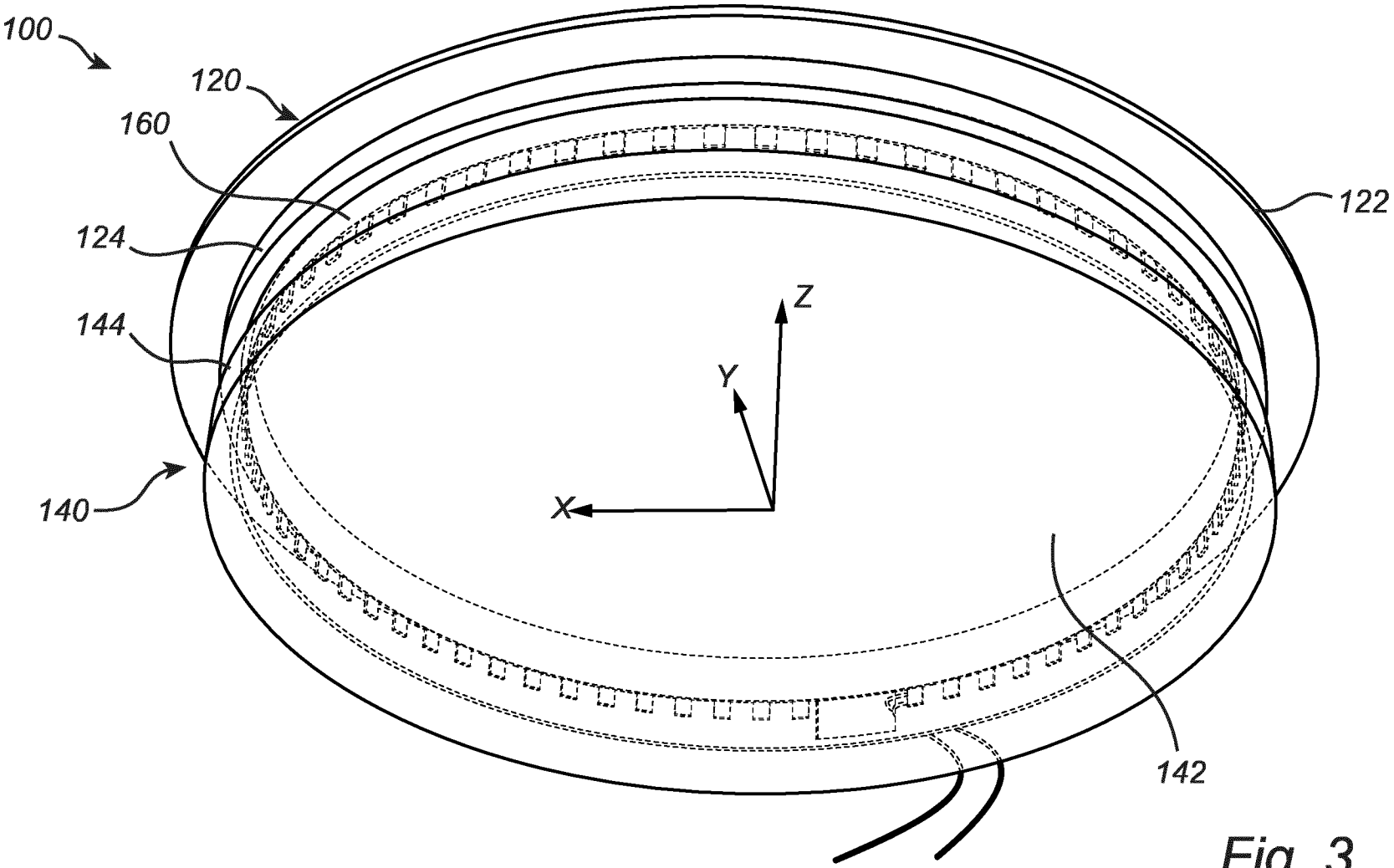
FIG. 3 illustrates a perspective view of a light mixing chamber.

FIG. 3 shows a perspective view of the light mixing chamber 100. As shown in FIG. 3, the light mixing chamber 100 may have a circular shape. FIG. 3 is illustrated such that plurality of LEDs facing an inner cavity 180 of the light mixing chamber 100 are visible. The first side wall 124 may extend along a circumference of the light exit window 122 of the first light mixing chamber part 120. The second side wall 144 may extend along a circumference of the bottom wall 142 of the second light mixing chamber part 140. The first groove 126 may extend along a circumference of the light mixing chamber 100. The second groove 146 may extend along the circumference of the light mixing chamber 100. The LED substrate 160 may extend along the circumference of the light mixing chamber 100.

Figure 4:
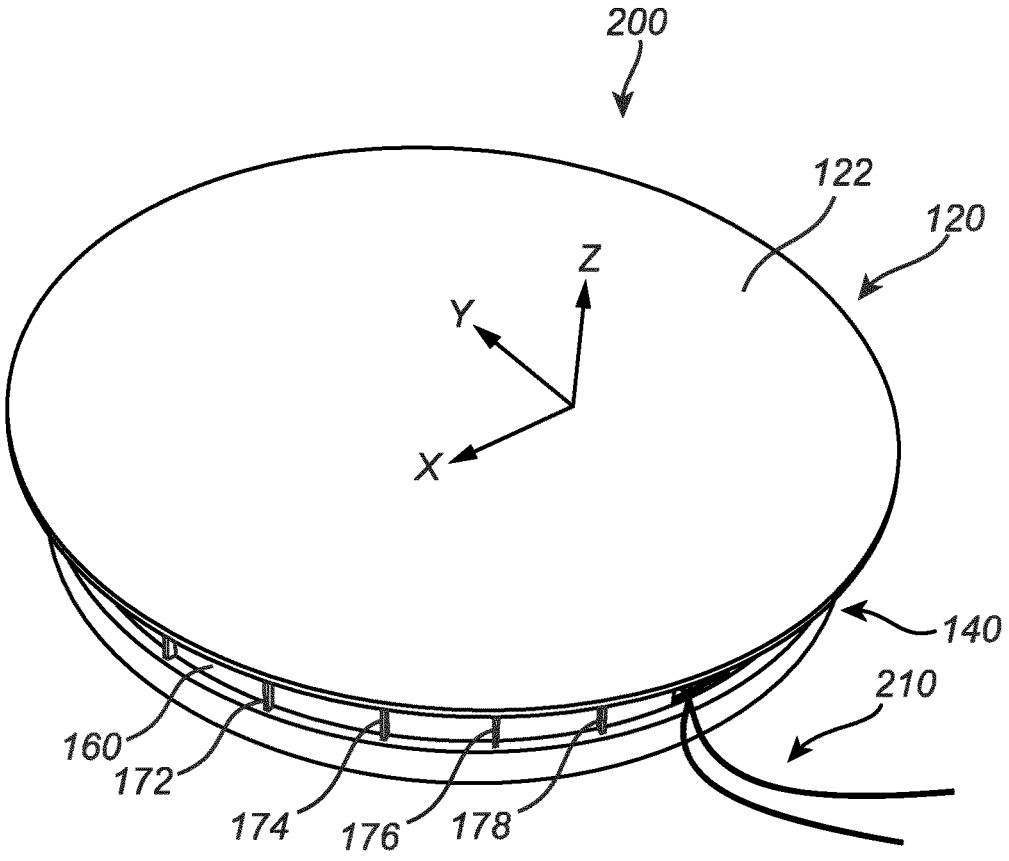
FIG. 4 shows a perspective view of a luminaire.

FIG. 4 shows a perspective view of a light exit window of a luminaire 200. The luminaire 200 comprises the light mixing chamber 100 and a connection 210 to a driver. The connection 210 is configured to connect the plurality of LEDs of the light mixing chamber 100 to a driver. The connection 210 in FIG. 4 is illustrated in the form of a wire. The connection 210 provides electricity to the plurality of LEDs of the light mixing chamber 100. The driver may be any conventional and commercially available driver. FIG. 4 further shows a plurality of fins 172, 174, 176, and 178 arranged on a back surface, the surface facing away from the inner cavity 180, of the LED substrate 160.

Figure 5:
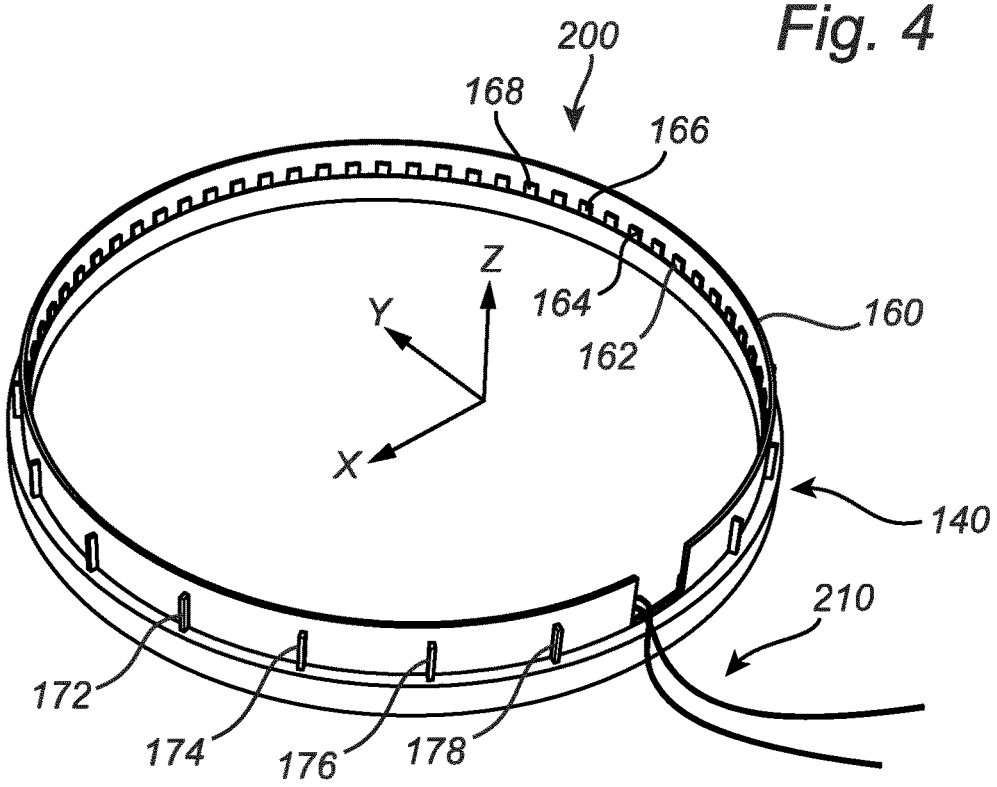
FIG. 5 shows a perspective view of parts of a luminaire.

FIG. 5 shows a perspective view of parts of the luminaire 200 shown in FIG. 4. Especially, the second light mixing chamber part 140, the LED substrate 160 and the connection 210 parts of the luminaire 200 are illustrated. FIG. 5 further shows a plurality of fins 172, 174, 176, and 178 arranged on a back surface, the surface facing away from the inner cavity 180, of the LED substrate 160. The LED substrate 160 supports a plurality of LEDs, such as LEDs 162, 164, 166, and 168. In FIG. 5 the luminaire 200 is illustrated in an "open state" i.e. the first light mixing chamber part 120 is disassembled form the light mixing chamber 100. As illustrated, by disconnecting the first light mixing chamber part 120, the LED substrate 160 is accessible. The LED substrate 160 may be hence replaced, if needed.

The luminaire 200 may be installed on a ceiling of a room such that the bottom wall 142 may face the ceiling and the light exit window 122 may face the room.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A light mixing chamber comprising:

a first light mixing chamber part comprising a light exit window and a first side wall having a first inner wall portion and a first outer wall portion, spaced apart and together forming a first groove, a second light mixing chamber part comprising a bottom wall and a second side wall having a second inner wall portion and a second outer wall portion, spaced apart and together forming a second groove, an inner cavity, and an LED substrate having a front surface facing the inner cavity and a back surface facing away from the inner cavity, the front surface supporting a plurality of LEDs, wherein the LED substrate is arranged into the first and second grooves, interconnecting the first and the second light mixing chamber parts such that the light mixing chamber is formed, wherein the first inner wall portion of the first side wall is extending further away from the light exit window than the first outer wall portion of the first side wall and/or the second inner wall portion of the second side wall is extending further away from the bottom wall than the second outer wall portion of the second side wall, and wherein between 5% to 50% of the back surface of the LED substrate is covered by the first and second grooves.

2. The light mixing chamber according to claim 1, wherein the first inner wall portion of the first side wall comprises a light reflective inner surface facing the inner cavity of the light mixing chamber and/or wherein the second inner wall portion of the second side wall comprises a light reflective inner surface facing the inner cavity of the light mixing chamber.

3. The light mixing chamber according to claim 1, wherein the LED substrate comprises a plurality of fins arranged on the back surface of the LED substrate.

4. The light mixing chamber according to claim 1, wherein the plurality of LEDs have a light emitting surface which is arranged at a distance from the first inner wall portion of the first side wall and from the second inner wall portion of the second side wall.

5. The light mixing chamber according to claim 1, wherein the LED substrate is a flexible elongated substrate.

6. The light mixing chamber according to claim 1, wherein the first side wall extends along a circumference of the light exit window of the first light mixing chamber part and/or wherein the second side wall extends along a circumference of the bottom wall of the second light mixing chamber part.

7. The light mixing chamber according to claim 1, wherein the first groove extends along a circumference of the light mixing chamber and/or wherein the second groove extends along the circumference of the light mixing chamber.

8. The light mixing chamber according to claim 1, wherein the first and second grooves cover the front surface of the LED substrate such that substantially only the plurality of LEDs faces the inner cavity of the light mixing chamber.

9. The light mixing chamber according to claim 1, wherein the LED substrate extends along the circumference of the light mixing chamber.

10. The light mixing chamber according to claim 1, wherein the bottom wall comprises a light reflective inner surface facing the inner cavity of the light mixing chamber and/or the light exit window is light diffusive having a reflectance in the range from 30% to 80%.

11. The light mixing chamber according to claim 1, wherein the LED substrate comprises two or more LED substrate portions.

12. A luminaire comprising the light mixing chamber according to claim 1 and a driver for driving the plurality of LEDs.

* * * * *